US006345547B1

(12) United States Patent
Stoelinga et al.

(10) Patent No.: US 6,345,547 B1
(45) Date of Patent: Feb. 12, 2002

(54) LINEAR ACTUATOR

(75) Inventors: Dirk Jan Stoelinga, Huizen; Pieter Jeroen Seinen, Bussum, both of (NL)

(73) Assignee: Actuall B.V., Bunschoten (NL)

( * ) Notice: Subject to any disclaimer, the term of this patent is extended or adjusted under 35 U.S.C. 154(b) by 0 days.

(21) Appl. No.: 09/509,483

(22) PCT Filed: Sep. 29, 1998

(86) PCT No.: PCT/NL98/00562

§ 371 Date: Jun. 13, 2000

§ 102(e) Date: Jun. 13, 2000

(87) PCT Pub. No.: WO99/16333

PCT Pub. Date: Apr. 8, 1999

(30) Foreign Application Priority Data

Sep. 29, 1997 (NL) ..... 1007160

(51) Int. Cl.[7] ..... F16H 19/04

(52) U.S. Cl. ..... 74/89.17; 74/422; 108/147; 187/270

(58) Field of Search ..... 74/89.17, 422; 108/147; 182/148; 187/270

(56) References Cited

U.S. PATENT DOCUMENTS

| | | | | |
|---|---|---|---|---|
| 1,634,854 A | * | 7/1927 | Scollard | 187/270 |
| 1,902,946 A | * | 3/1933 | Breed | 187/270 X |
| 4,073,227 A | * | 2/1978 | Moriconi | 100/52 |
| 5,558,181 A | * | 9/1996 | Bundo | 187/270 |

FOREIGN PATENT DOCUMENTS

| | | |
|---|---|---|
| DE | 3719012 A1 | 12/1988 |
| DE | 9213553.6 | 1/1993 |
| DE | 9213866.7 | 1/1993 |
| DE | 4417337 A1 | 11/1995 |

* cited by examiner

*Primary Examiner*—Allan D. Herrmann
(74) *Attorney, Agent, or Firm*—Young & Thompson

(57) ABSTRACT

A linear actuator includes an inner section that moves within an outer section. The inside of the outer section includes racks and the outside of the inner section includes pinions that engage the racks. Two pairs of racks and pinions are positioned at an angle of 90° with respect to each other. The outer section includes at least two pairs of sides located opposite to one another and one of the racks is mounted on each of the sides.

9 Claims, 4 Drawing Sheets

LINEAR ACTUATOR

BACKGROUND OF THE INVENTION

The present invention relates to a linear actuator comprising an outer section having a longitudinal axis and an inner structure which is fitted inside the outer section and is movable with respect thereto in the direction of said longitudinal axis.

An actuator of this type is generally known in the prior art. Pneumatic and hydraulic cylinders are used for moving all kinds of components which are movable with respect to one another. Motor-driven structures are also known.

There is a need, for furniture, such as chairs, desks and other applications, for an actuator which in the smallest position has a small structural height, with which there is no play between the inner structure and the outer section in any of the extended positions, which is simple and inexpensive to produce and including an autonomous drive.

SUMMARY OF THE INVENTION

This aim is realised with an actuator as described above in that the outer section is provided with at least two racks which extend in the direction of said longitudinal axis and the inner structure comprises an equal number of pinions engaging on the racks, said pinions being mechanically linked and at least one pinion being drivable by a motor mounted in said inner structure in order to achieve operation of said actuator.

The invention is based on the insight of providing the inner structure with an (electric) drive motor. This motor drives at least one pinion. Further pinions are fitted in order to provide accurate guiding of the inner section with respect to the outer section. If, in accordance with an advantageous embodiment of the invention, both the outer section and the inner structure are constructed as square tubular sections, it is advantageous that two drive pinions are provided which are mounted close to the mid-points of two opposing sides, as well as two auxiliary pinions which take up play and which are likewise mounted opposite one another on the two mid-points of the two adjoining sides. In such a case the first-mentioned and the last-mentioned pinions are coupled to one another by a connecting shaft. It has been found that in this way a particularly small space requirement coupled with an appreciable stroke can be obtained with a compact motor. It has also been found that negligible play between the inner structure and the outer section occurs throughout said stroke and a particularly rigid unit is produced.

It is possible for two pinions/racks to suffice. However, according to an advantageous embodiment of the invention at least three racks and an equal number of pinions are provided, at least two of said pinions being mechanically coupled.

Retaining means which provide for positioning of the inner structure and the outer section with respect to one another can be provided as additional elements to take up possible play. This retaining means can, for example, be arranged to provide fixed engagement between the non-driven pinions and the rack concerned. Furthermore, it is possible to choose the thickness of the racks such that the inner structure is held in position with respect to the outer section.

Although it has been described above that both the outer section and the inner structure are constructed as square tubular sections, it must be understood that any other shape imaginable in the prior art is possible. Such a shape varies from triangular to polygonal and from circular to elliptical, it not being necessary for the outer section to have a shape which is congruent with the shape of the inner structure. The motor described above can be any motor known from the prior art, but an electric motor that drives the pinions concerned, with or without the aid of a transmission, is preferred. By this means it is possible to provide a very compact structure, with which appreciable loads can be moved, with a small space requirement. An actuator of this type can, for example, be used for the column of a chair or also for adjusting desks. It must be understood that this is merely an example and that many other applications of the actuator according to the present invention are conceivable.

BRIEF DESCRIPTION OF THE DRAWINGS

The invention will be explained in more detail below with reference to an illustrative embodiment shown in the drawing. In the drawing.

DESCRIPTION OF THE PREFERRED EMBODIMENTS

Figure 1:
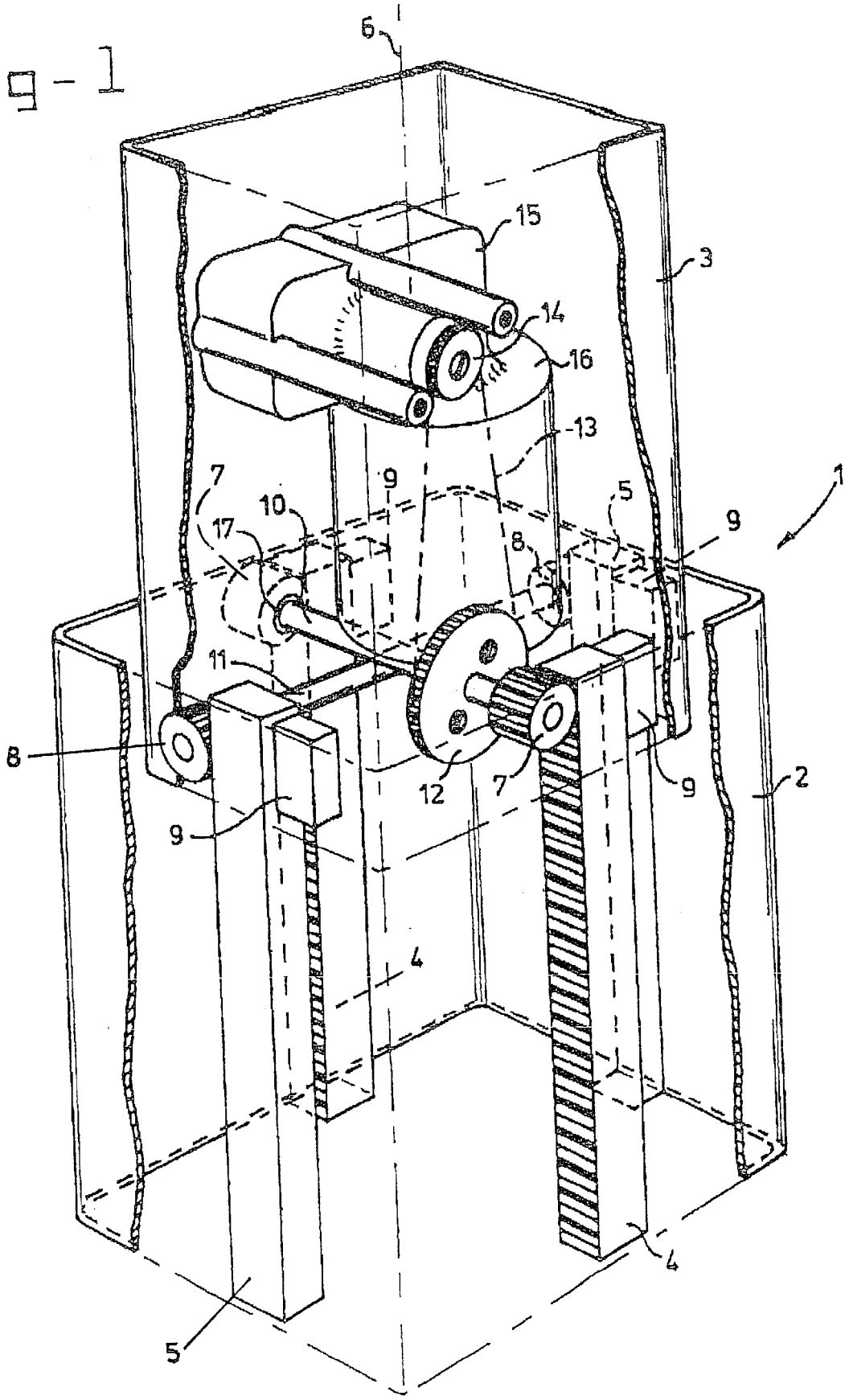
FIG. 1 shows an exposed view of the actuator according to the invention in a first extended position.
Figure 2:
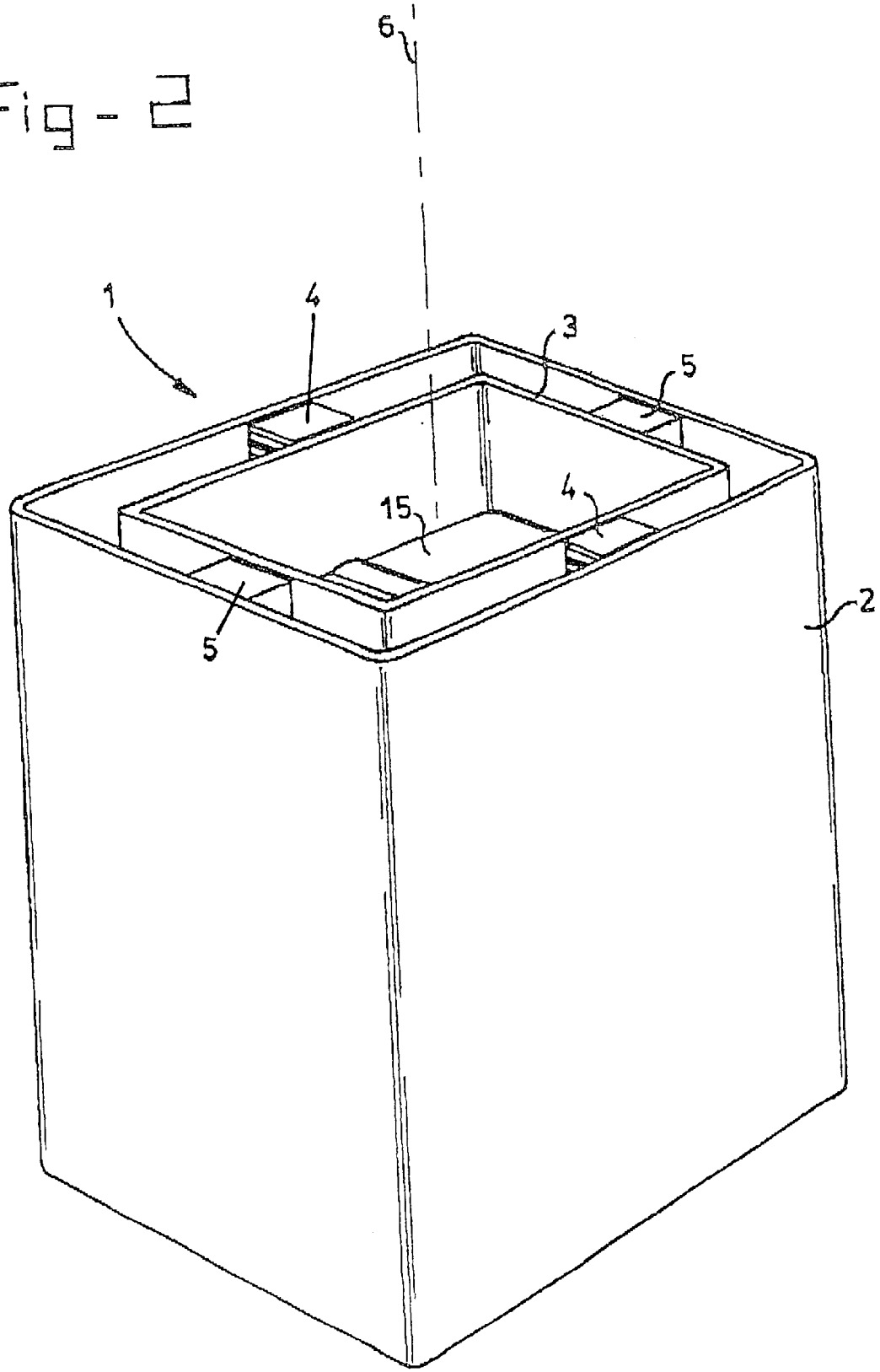
FIG. 2 shows a perspective view of the actuator according to FIG. 1 in the retracted position.
Figure 3:
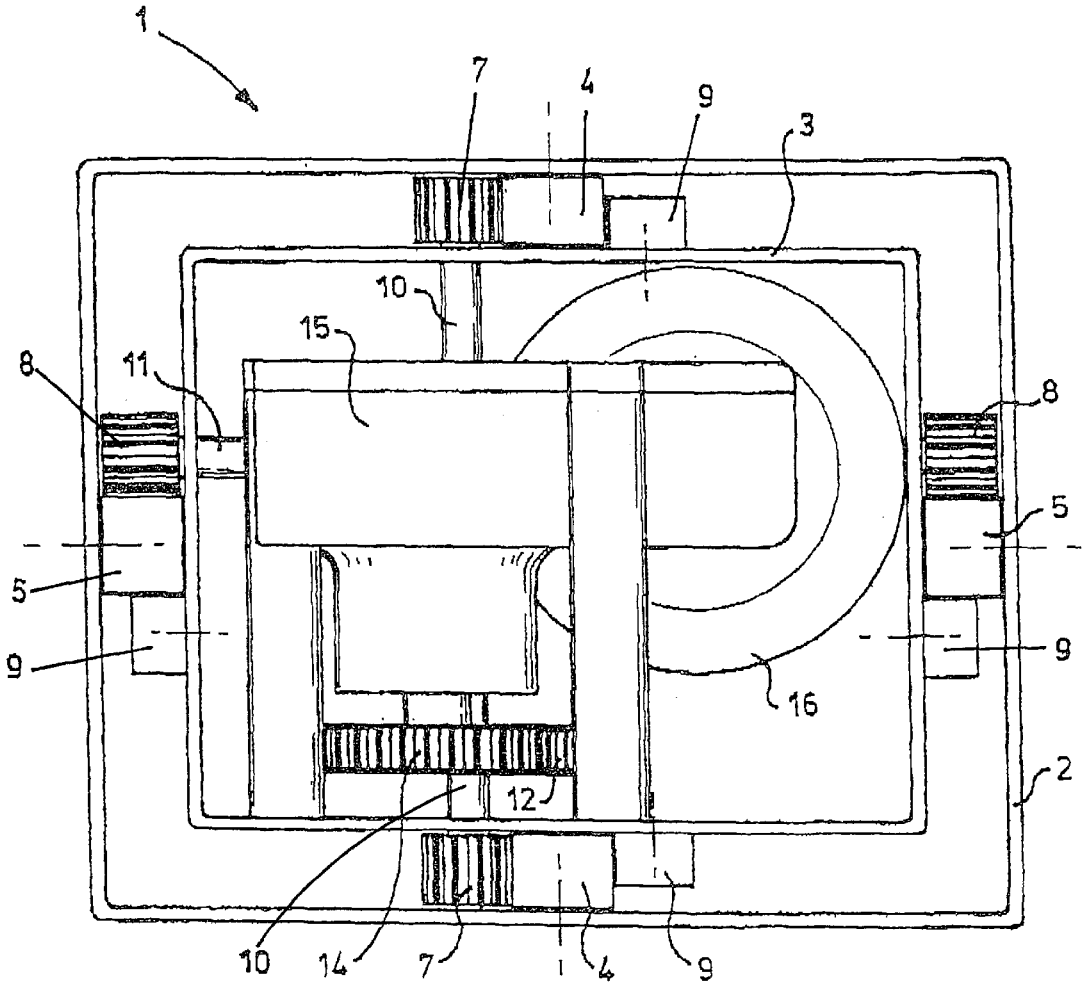
FIG. 3 shows a top view of the actuator according to the invention.

In FIG. 1 the linear actuator according to the invention is indicated in its entirety by 1. This actuator consists of an outer section 2, which in this embodiment has been constructed as a square tubular section. A tubular section that is likewise square and that acts as inner section and is indicated by 3 is fitted inside the outer section 2. The inner section 3 is so much smaller than the outer section 2 that racks 4 and 5, which are mounted on the outer section, can be accommodated between the two sections. Racks 4 engage with pinions 7, which are joined to one another via a shaft 10, whilst the racks 5 are engaged by pinions 8 which are joined, for example by means of a keyway, to shaft 11. There are openings 17 in the inner section 3 to allow shafts 10 and 11 to be fed through. A sprocket 12 is mounted on shaft 10, a chain 13, which is engaged by gear 14, running over sprocket 12 and, via worm transmission 15, electric motor 16 drives pinions 7. Pinions 7 are driven into engagement with rack 4 by the presence of retaining blocks 9, which are firmly mounted on opposing outer sides of the inner section.

Movement of the inner section 3 with respect to the outer section 2 takes place in accordance with a longitudinal axis 6. By operation of motor 16, pinions 7 are driven and movement with respect to the racks 4 takes place. As a result of the presence of pinions 8, which are coupled to one another via shaft 11 and, moreover, engage on racks 5, it has been found that a low-play rigid structure is produced, the inner section 3 displaying virtually no play with respect to the outer section 2. As a result of the worm transmission in transmission 15, a self-braking structure is produced, that is to say movement of the inner section with respect to the outer section is possible only by operation of motor 16.

It will be understood that it is not necessary for the inventive concept for two pinions 8 located opposite one another to be present. For instance, it is possible to construct both the outer section 2 and the inner section 3 in the form of a U-section. It must also be understood that any other shape differing from the square or U-shape is possible. The motor 16 used, which can be any motor known from the prior art, is preferably a so-called windscreen wiper motor which can be controlled by a relatively low voltage and develops appreciable power for small installation dimensions and a low cost price.

Figure 4:
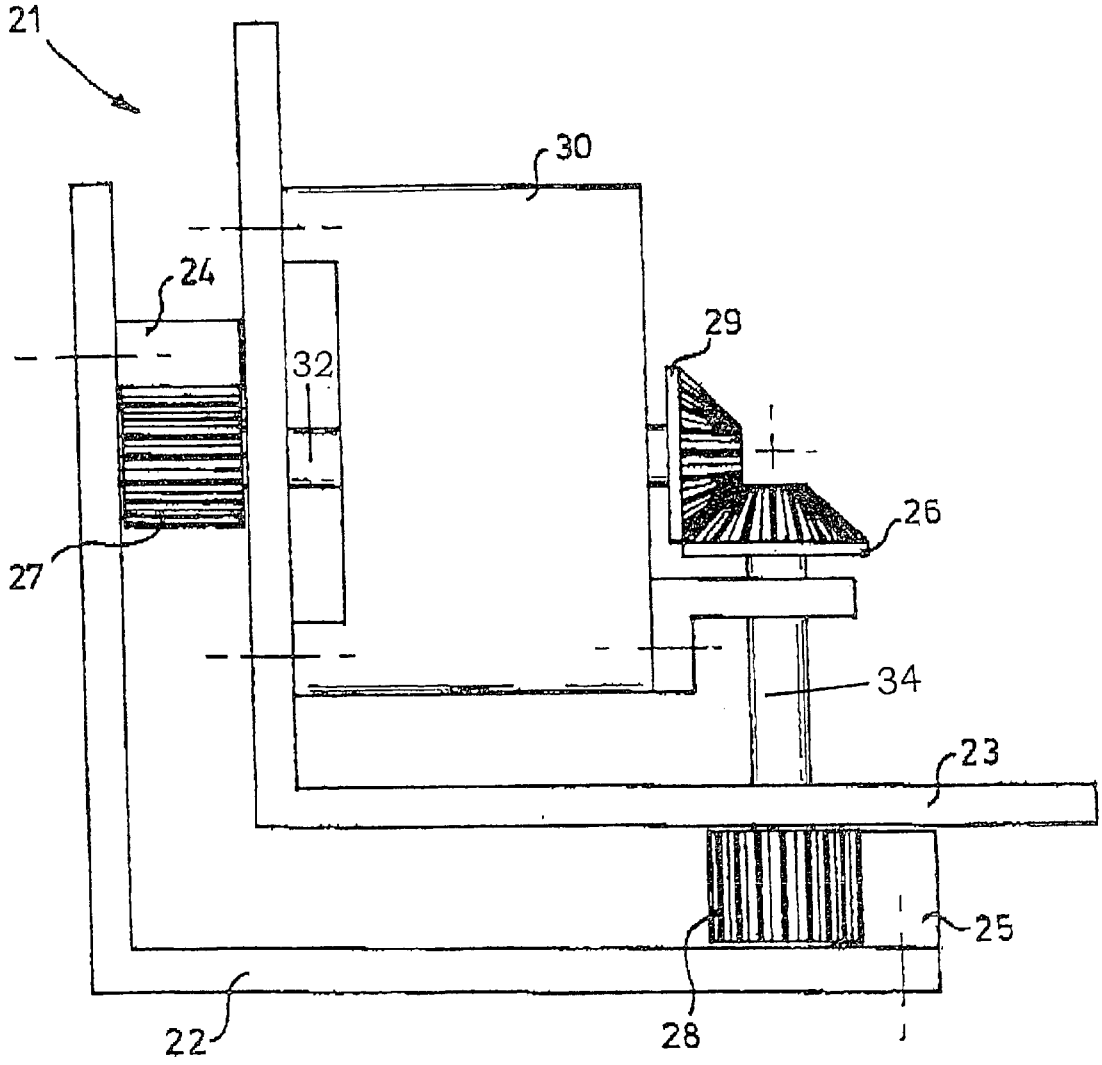
FIG. 4 shows a first variant of the actuator according to the invention.

FIG. 4 shows a further variant of the invention in which only two pinions/racks are used. This actuator is indicated in its entirely by 21 and consists of an inner section 23 and an outer section 22. The outer section 22 is provided with racks 24, 25, close to each end thereof, whilst the angular inner section is provided with pinions 27, 28 located towards the inside. With this arrangement, pinion 27 is driven directly by motor 30 through shaft 32, which on the other side is provided with a conical gear 29, which is in engagement with conical gear 26 to which pinion 28 is connected through shaft 34. This structure is self-retaining and is found to have surprisingly little play.

It sill be understood that many variants of the actuator described above are possible. Numerous structural details can be modified without going beyond the scope of the present application. Moreover, it must be understood that the linear actuator described above has numerous possible applications. All such variants and applications are considered to fall within the scope of the appended claims and have the abovementioned advantages, these being a high (radial) rigidity of the actuator in both the retracted and the extended position, whilst it is possible to produce a relatively high lifting force.

What is claimed is:

1. Linear actuator (1, 2) comprising:

an outer section (2, 22) having a longitudinal axis (6);

an inner structure which is mounted inside the outer section and is movable with respect thereto in the direction of said longitudinal axis, wherein the outer section (2, 22) is provided with at least two racks (4, 5, 24, 25) which extend in the direction of said longitudinal axis and the inner structure comprises an equal number of pinions (7, 8, 27, 28) engaging on the racks, said pinions (7, 8, 27, 28) being mechanically linked and at least one pinion (7, 27) being drivable by a motor (16, 30) mounted in said inner structure in order to achieve operations of said actuator, wherein said outer section (2) comprises at least two pairs of sides located opposite one another and one of said racks is mounted on each of said sides.

2. Actuator according to claim 1, wherein at least three racks (4, 5) and pinions (7, 8) are provided, at least two of said pinions being mechanically coupled.

3. Actuator according to claim 1, wherein retaining means (9) which provide for positioning of the inner structure and the outer section are provided.

4. Actuator according to claim 3, wherein said retaining means (9) fix the position of the pinion (7) and the rack (4) with respect to one another.

5. Actuator according to claim 1, wherein said outer section (2) is a closed section.

6. Actuator according to claim 1, wherein the pinions (7, 8) located opposite one another are always mechanically linked.

7. Actuator according to claim 1, wherein the inner structure comprises a section (3) within which said motor (16) is accommodated.

8. Actuator according to claim 7, wherein said inner section comprises a closed section provided with openings through which connecting shafts (10, 11) for a pair of pinions extend.

9. Actuator according to claim 2, wherein retaining means (9) which provide for positioning of the inner structure and the outer section are provided.

* * * * *